US010134324B2

(12) United States Patent
Kim et al.

(10) Patent No.: US 10,134,324 B2
(45) Date of Patent: Nov. 20, 2018

(54) DEVICE AND METHOD FOR CORRECTING GAMMA SET DATA

(71) Applicant: SAMSUNG DISPLAY CO., LTD., Yongin-si, Gyeonggi-do (KR)

(72) Inventors: Tae Wook Kim, Yongin-si (KR); Yeon Shil Jung, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 36 days.

(21) Appl. No.: 15/353,769

(22) Filed: Nov. 17, 2016

(65) Prior Publication Data

US 2017/0169752 A1 Jun. 15, 2017

(30) Foreign Application Priority Data

Dec. 9, 2015 (KR) ..... 10-2015-0175057

(51) Int. Cl.
*G09G 3/20* (2006.01)
*G09G 5/393* (2006.01)
*G09G 5/02* (2006.01)

(52) U.S. Cl.
CPC ..... *G09G 3/2007* (2013.01); *G09G 3/2003* (2013.01); *G09G 5/393* (2013.01); *G09G 5/024* (2013.01); *G09G 2320/0276* (2013.01); *G09G 2320/0673* (2013.01); *G09G 2330/028* (2013.01)

(58) Field of Classification Search
CPC .... G09G 3/2007; G09G 5/393; G09G 3/2003; G09G 5/024; G09G 2320/0276; G09G 2330/028; G09G 2320/0673
See application file for complete search history.

(56) References Cited

U.S. PATENT DOCUMENTS

2006/0164355 A1* 7/2006 Kim ..... G09G 3/3648 345/89
2012/0032995 A1* 2/2012 Lee ..... G09G 3/2011 345/690
2013/0083083 A1* 4/2013 Woo ..... G09G 3/3208 345/690

(Continued)

FOREIGN PATENT DOCUMENTS

EP 2 750 125 A2 7/2014
KR 10-2015-0007061 A 1/2015

OTHER PUBLICATIONS

Extended European Search Report dated Mar. 10, 2017, to the European Patent Application No. 16202775.9 filed on Dec. 7, 2016.

*Primary Examiner* — Premal R Patel
(74) *Attorney, Agent, or Firm* — Lee & Morse, P.C.

(57) ABSTRACT

A device for correcting gamma set data includes a memory, voltage calculator, and a corrector. The memory stores high gamma set data including first register values set per grayscale and low gamma set data including second register values set per grayscale and reference register value. The voltage calculator calculates a reference voltage value of the low gamma set data based on the reference register value and calculates fixed voltage values per grayscale of the low gamma set data based on the second register values. The corrector compares the first register values with the second register values and corrects the second register values based on a comparison result.

10 Claims, 6 Drawing Sheets

(56) References Cited

U.S. PATENT DOCUMENTS

| | | | | |
|---|---|---|---|---|
| 2013/0113842 | A1* | 5/2013 | Hwang | G09G 3/2022 345/690 |
| 2013/0249955 | A1* | 9/2013 | Kim | G09G 3/3233 345/690 |
| 2014/0118228 | A1* | 5/2014 | Kang | G09G 3/3233 345/77 |
| 2014/0184657 | A1* | 7/2014 | Lee | G09G 5/10 345/690 |
| 2015/0138251 | A1* | 5/2015 | Pyo | G09G 3/3233 345/690 |
| 2016/0189676 | A1* | 6/2016 | Pyo | G09G 3/3291 345/690 |
| 2016/0314761 | A1 | 10/2016 | Kim | |

* cited by examiner

GSD13

| | R | G | B |
|---|---|---|---|
| VT | 85 | 101 | 85 |
| G0 | 210 | 227 | 203 |
| G1 | 211 | 228 | 204 |
| G11 | 205 | 217 | 207 |
| G23 | 221 | 226 | 224 |
| G35 | 223 | 225 | 220 |
| G51 | 209 | 211 | 208 |
| G87 | 205 | 207 | 205 |
| G151 | 224 | 225 | 224 |
| G203 | 230 | 230 | 228 |
| G255 | 266 | 251 | 311 |

GSD11

| | R | G | B |
|---|---|---|---|
| VT | 85 | 101 | 85 |
| G0 | 209 | 226 | 203 |
| G1 | 211 | 228 | 202 |
| G11 | 203 | 216 | 205 |
| G23 | 220 | 225 | 224 |
| G35 | 223 | 224 | 219 |
| G51 | 209 | 211 | 207 |
| G87 | 204 | 206 | 204 |
| G151 | 223 | 224 | 224 |
| G203 | 229 | 228 | 228 |
| G255 | 264 | 250 | 308 |

. . . . .

GSD1

| | R | G | B |
|---|---|---|---|
| VT | 70 | 85 | 70 |
| G0 | 199 | 210 | 183 |
| G1 | 201 | 215 | 182 |
| G11 | 193 | 206 | 185 |
| G23 | 210 | 215 | 204 |
| G35 | 213 | 214 | 199 |
| G51 | 199 | 201 | 187 |
| G87 | 194 | 190 | 184 |
| G151 | 213 | 210 | 204 |
| G203 | 210 | 210 | 208 |
| G255 | 230 | 240 | 274 |

FIG. 6

GSD_H

| | R | G | B |
|---|---|---|---|
| VT | 85 | 101 | 85 |
| G0 | 210 | 227 | 203 |
| G1 | 211 | 228 | 204 |
| G11 | 205 | 217 | 207 |
| G23 | 221 | 226 | 224 |
| G35 | 223 | 225 | 220 |
| G51 | 209 | 211 | 208 |
| G87 | 205 | 207 | 205 |
| G151 | 224 | 225 | 224 |
| G203 | 230 | 230 | 228 |
| G255 | 266 | 251 | 311 |

GSD_L

| | R | G | B |
|---|---|---|---|
| VT | 85 | 101 | 85 |
| G0 | 209 | 226 | 202 |
| G1 | 211 | 227 | 204 |
| G11 | 206 | 218 | 208 |
| G23 | 220 | 224 | 224 |
| G35 | 223 | 225 | 220 |
| G51 | 208 | 210 | 207 |
| G87 | 207 | 209 | 207 |
| G151 | 222 | 225 | 223 |
| G203 | 232 | 232 | 230 |
| G255 | 251 | 236 | 293 |

FIG. 7

| | R |
|---|---|
| VT | VT1 |
| G0 | Vg0 |
| G1 | Vg1 |
| G11 | Vg11 |
| G23 | Vg23 |
| G35 | Vg35 |
| G51 | Vg51 |
| G87 | Vg87 |
| G151 | Vg151 |
| G203 | Vg203 |
| G255 | Vgh |

DEVICE AND METHOD FOR CORRECTING GAMMA SET DATA

CROSS-REFERENCE TO RELATED APPLICATION

Korean Patent Application No. 10-2015-0175057, filed on Dec. 9, 2015, and entitled: "Device and Method for Correcting Gamma Set Data," is incorporated by reference herein in its entirety.

BACKGROUND

1. Field

One or more embodiments described herein relate to a device and a method for correcting gamma set data.

2. Description of the Related Art

A variety of displays have been developed that are lighter in weight and smaller in volume than cathode ray tube displays. Examples include liquid crystal displays, field emission displays, plasma displays, and organic light emitting displays. These devices generally include a scan driver to supply scan signals to pixels, a data driver to supply data signals to the pixels, and a grayscale voltage generator to supplying grayscale voltages to the data driver. The grayscale voltage generator may receive a plurality of gamma set data from an external gamma set data generating device, select one of the gamma set data corresponding to a dimming level, and generate grayscale voltages corresponding to the selected gamma set data.

SUMMARY

In accordance with one or more embodiments, a device for correcting gamma set data includes a memory to store high gamma set data including first register values set per grayscale and low gamma set data including second register values set per grayscale and reference register value; a voltage calculator to calculate a reference voltage value of the low gamma set data based on the reference register value and to calculate fixed voltage values per grayscale of the low gamma set data based on the second register values; and a corrector to compare the first register values with the second register values and correct the second register values based on a comparison result.

The voltage calculator may calculate the reference voltage value from the reference register value based on Formula 1:

$$VT1=VREG1-VREG1*(RVr/N2)$$

where VT1 is a reference voltage value, VREG1 is a first constant, RVr is a reference register value, and N2 is a second constant.

The voltage calculator may calculate a fixed voltage value from a second register value corresponding to highest grayscale based on Formula 2:

$$Vgh=VREG1-VREG1*(RVh/N3)$$

where Vgh is a fixed voltage value of the highest grayscale, VREG1 is a first constant, RVh is a second register value corresponding the highest grayscale, and N3 is a third constant.

The voltage calculator may calculate fixed voltage values from second register values corresponding to remaining grayscales excluding the highest grayscale based on Formula 3:

$$Vgc=VT1-(VT1-Vgp)*(RVc/N4)$$

where Vgc is a fixed voltage value of a current grayscale, VT1 is a reference voltage value, Vgp is a fixed voltage value of a grayscale that is one level higher than the current grayscale, RVc is a second register value corresponding to the current grayscale, and N4 is a fourth constant.

The corrector may compare a first register value corresponding a certain grayscale with a second register value corresponding the certain grayscale, and when the second register value is greater than the first register value upon comparison, the corrector may change the second register value to be equal to the first register value.

The corrector may update the reference voltage value to a value that satisfies the Formula 3 based on a fixed voltage value corresponding to the certain grayscale and a changed second register value. The corrector may update second register values for remaining grayscales excluding the certain grayscale and the highest grayscale based on the updated reference voltage value and Formula 3. The corrector may update the reference register value to a value satisfying Formula 1 based on the updated reference voltage value.

When the updated reference register value exceeds a predefined comparison value, the corrector may reduce the reference register value to the comparison value or less. When there is a second register value having a value 0 in the low gamma set data, the corrector may increase the second register value having the value 0.

In accordance with one or more other embodiments, a method of correcting gamma set data includes calculating a reference voltage value and fixed voltage values per grayscale of a low gamma set data based on a reference register value and second register values set per grayscale in the low gamma set data; comparing first register values in a high gamma set data with second register values in the low gamma set data; and correcting the second register values depending on a comparison result.

Calculating the reference voltage value and fixed voltage values per grayscale may include calculating the reference voltage value from the reference register value based on Formula 1:

$$VT1=VREG1-VREG1*(RVr/N2)$$

where VT1 is a reference voltage value, VREG1 is a first constant, RVr is a reference register value and N2 is a second constant.

Calculating the reference voltage value and fixed voltage values per grayscale may include calculating a fixed voltage value from a second register value corresponding to highest grayscale based on Formula 2:

$$Vgh=VREG1-VREG1*(RVh/N3)$$

where Vgh is a fixed voltage value of the highest grayscale, VREG1 is a first constant, RVh is a second register value corresponding to the highest grayscale, and N3 is a third constant.

Calculating the reference voltage value and fixed voltages per grayscale may include calculating fixed voltage values from second register values corresponding to remaining grayscales excluding the highest grayscale based on Formula 3:

$$Vgc=VT1-(VT1-Vgp)*(RVc/N4)$$

where Vgc is a fixed voltage value of a current grayscale, VT1 is a reference voltage value, Vgp is a fixed voltage value of a grayscale that is one level higher than the current grayscale, RVc is a second register value corresponding to the current grayscale, and N4 is a fourth constant.

Correcting the second register values may include comparing a first register value corresponding to a certain grayscale with a second register value corresponding to the certain grayscale; and changing the second register value to be equal to the first register value when the second register value is greater than the first register value.

Correcting the second register values may include updating the reference voltage value to a value that satisfies Formula 3 based on a fixed voltage value corresponding to the certain grayscale and the changed second register value.

Correcting the second register values may include updating second register values corresponding to remaining grayscales excluding the certain grayscale and the highest grayscale based on the updated reference voltage value and the Formula 3.

Correcting the second register values may include updating the reference register value to a value that satisfies Formula 1 based on the updated reference voltage value.

Correcting the second register values may include reducing the reference register value to the comparison value or less when the updated reference register value exceeds the predefined comparison value.

Correcting the second register values may include increasing a second register value having a value of 0 when there is a second register value having the value of 0 in the low gamma set data.

BRIEF DESCRIPTION OF THE DRAWINGS

Features will become apparent to those of skill in the art by describing in detail exemplary embodiments with reference to the attached drawings in which:

FIG. 6 illustrates examples of high gamma set data and low gamma set data;

FIG. 7 illustrates examples of voltage values based on low gamma set data;

DETAILED DESCRIPTION

Figure 1:
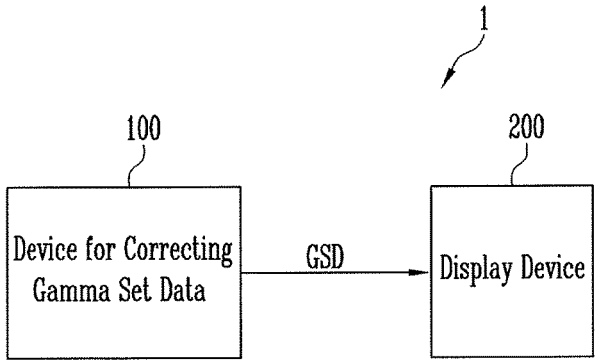
FIG. 1 illustrates an embodiment of a gamma set data setting system.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. It will also be understood that when a layer is referred to as being "between" two layers, it can be the only layer between the two layers, or one or more intervening layers may also be present. Like reference numerals may refer to like elements throughout.

In addition, it will be understood that when an element or layer is referred to as being "on," "connected to," or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

FIG. 1 illustrates an embodiment of a gamma set data setting system 1 which includes a gamma set data correcting device 100 and a display device 200. The gamma set data correcting device 100 may generate multiple gamma set data GSD and perform correction on at least a portion of the multiple gamma set data GSD in order to prevent a brightness reversal phenomenon from occurring. The gamma set data GSD, for which correction is completed, may be supplied from the gamma set data correcting device 100 to the display device 200. The display device 200 may store multiple gamma set data GSD from the gamma set data correcting device 100.

Figure 2:
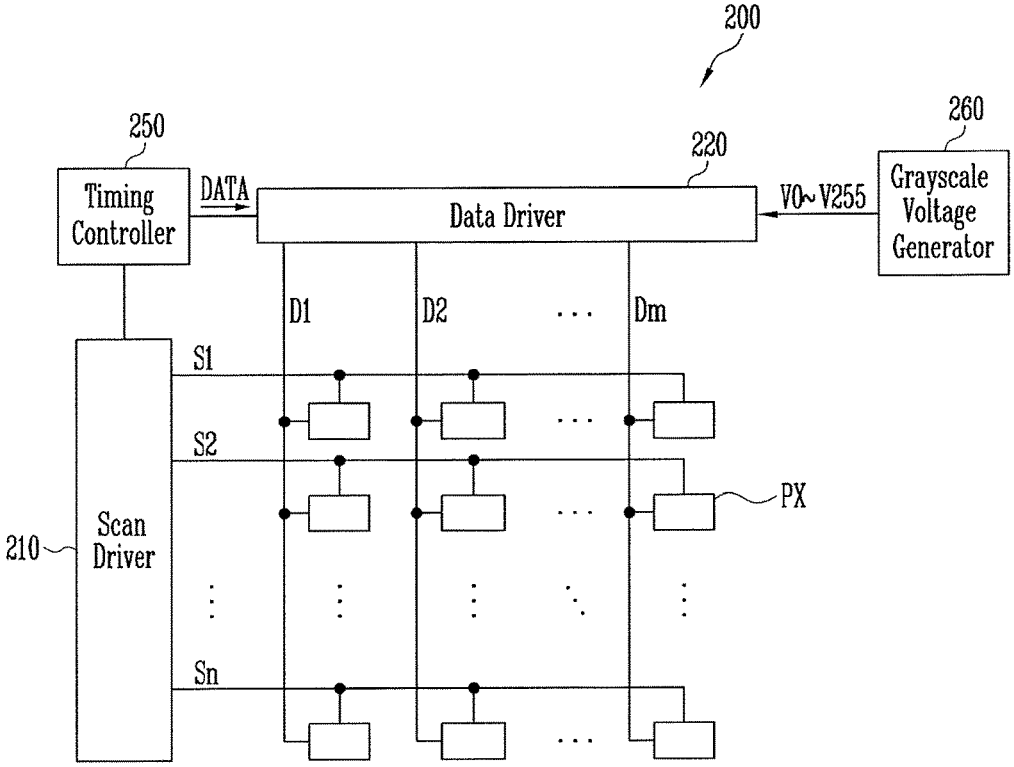
FIG. 2 illustrates an embodiment of a display device.

FIG. 2 illustrates an embodiment of a display device 200 which includes multiple pixels PX, a scan driver 210, a data driver 220, a timing controller 250 and a grayscale voltage generator 260. The pixels PX may be coupled to scan lines S1 to Sn and data lines D1 to Dm. The pixels PX receive scan signals through the scan lines S1 to Sn and data voltages through the data lines D1 to Dm.

The scan driver 210 generates scan signals under control of the timing controller 250 and supplies the scan signals to the pixels PX through scan lines S1 to Sn.

The data driver 220 generates data voltages under control of the timing controller 250 and supplies the voltage to the pixels PX through data lines D1 to Dm.

The timing controller 250 controls the scan driver 210 and the data driver 220. For example, the timing controller 250 may supply various control signals to the scan driver 210 and the data driver 220 and supply image data DATA to the data driver 220.

The grayscale generator 260 generates multiple grayscale voltages V0 to 255 using a gamma set data GSD from a gamma set data correcting device 100. Also, the grayscale voltage generator 260 may supply multiple grayscale voltages V0 to V255 to the data driver 220. The data driver 220 generates data voltages corresponding to the image data DATA using the grayscale voltages V0 to V255.

When a scan signal is supplied to a scan line, the pixels PX coupled to the scan line may receive data voltages from corresponding data lines D1 to Dm and emit light with brightness corresponding to the data voltages.

Figure 3:
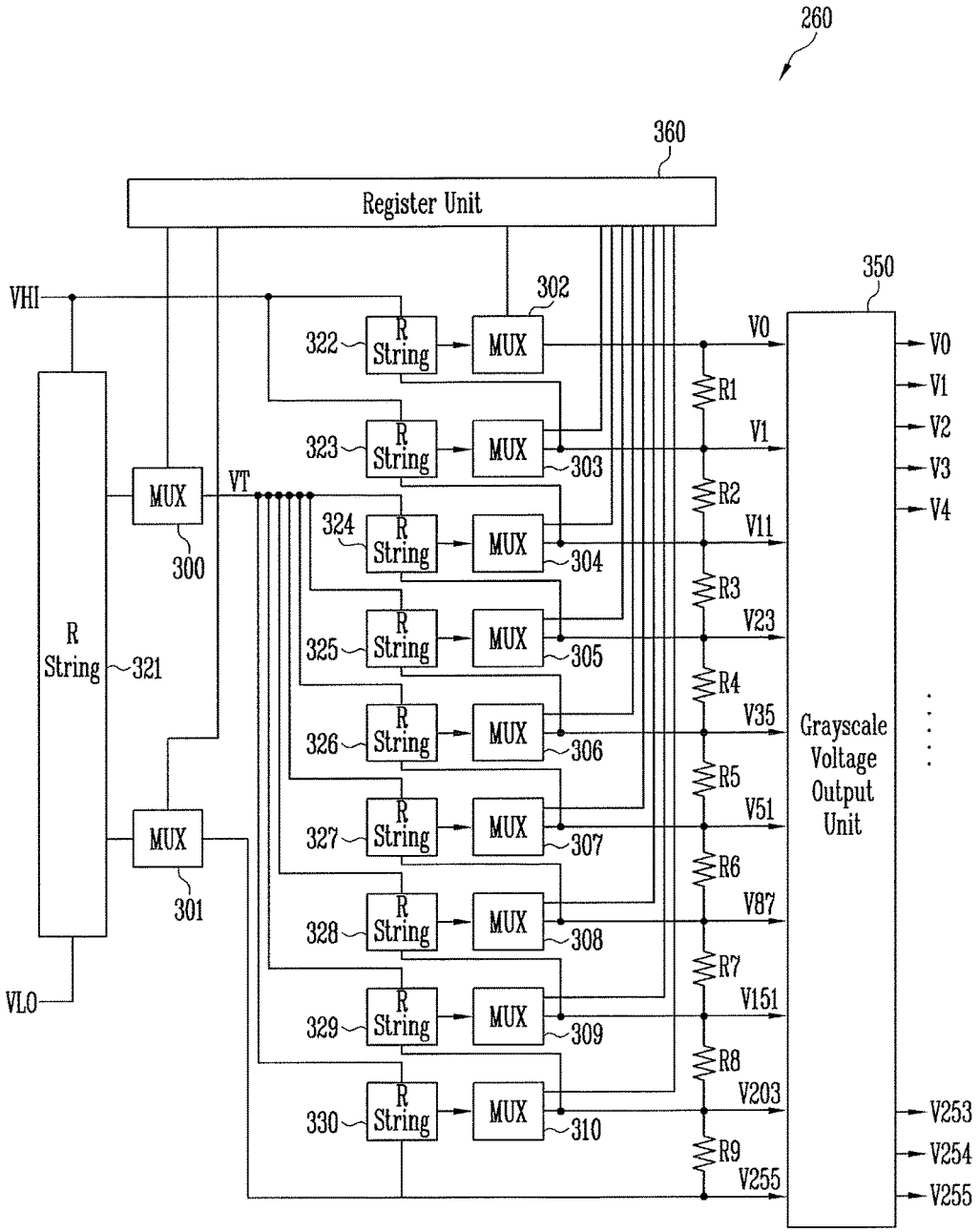
FIG. 3 illustrates an embodiment of a grayscale voltage generator.

FIG. 3 illustrates an embodiment of a grayscale voltage generator 260 which includes multiple mux 300 to 310 or multiplexers, multiple resistor strings 321 to 330, a grayscale voltage output unit 350, and a register unit 360. The first resistor string 321 may receive a first power voltage VHI and a second power voltage VL0 and generate middle voltages between the first power voltage VHI and the second power voltage VL0.

A reference voltage mux 300 selects any one of multiple middle voltages output from the first resistor string 321 and outputs the selected middle voltage as the reference voltage VT.

The first mux 301 selects any one of multiple middle voltages output from the first resistor string 321 and outputs the selected middle voltage as a 255th grayscale voltage V255.

A second resistor string 322 may receive a first power voltage VHI and a first grayscale voltage V1 and generate middle voltages between the first power voltage VHI and the first grayscale voltage V1.

A second mux 302 selects one of multiple middle voltages output from second resistor string 322 and outputs the selected middle voltage as 0th grayscale voltage V0.

A third resistor string 323 may receive a first power voltage VHI and an eleventh grayscale voltage V11 and generate middle voltages between the first power voltage VHI and the eleventh grayscale voltage V11.

A third mux 303 selects one of multiple middle voltages output from the third resistor string 323 and outputs the selected middle voltage as the first grayscale voltage V1.

A fourth resistor string 324 may receive a reference voltage VT and a 23rd grayscale voltage V23 and generate middle voltages between the reference voltage VT and a 23rd grayscale voltage V23.

A fourth mux 304 selects any one of multiple middle voltages output from the fourth resistor string 324 and outputs the selected middle voltage as an eleventh grayscale voltage V11.

A fifth resistor string 325 may receive a reference voltage VT and a 35th grayscale voltage V35 and generate middle voltages between the reference voltage VT and the 35th grayscale voltage V35.

A fifth mux 305 selects one of multiple middle voltages output from the fifth resistor string 325 and outputs the selected middle voltage as a 23rd grayscale voltage V23.

A sixth resistor string 326 may receive a reference voltage VT and a 51st grayscale voltage V51 and generate middle voltages between the reference voltage VT and the 51st grayscale voltage V51.

A sixth mux 306 selects one of multiple middle voltages output from the sixth resistor string 326 and outputs the selected middle voltage as 35th grayscale voltage V35.

A seventh resistor string 327 may receive a reference voltage VT and an 87th grayscale voltage V87 and generate middle voltages between the reference voltage VT and the 87th grayscale voltage V87.

A seventh mux 307 selects one of multiple middle voltages output from seventh resistor string 327 and outputs the selected middle voltage as 51st grayscale voltage V51.

An eighth resistor string 328 may receive a reference voltage VT and a 151st grayscale voltage V151 and generate middle voltages between the reference voltage VT and the 151st grayscale voltage V151.

An eighth mux 308 selects one of multiple middle voltages output from eighth resistor string 328 and outputs the selected middle voltage as 87th grayscale voltage V87.

A ninth resistor string 329 may receive a reference voltage VT and a 203rd grayscale voltage V203 and generate middle voltages between the reference voltage VT and the 203rd grayscale voltage V203.

A ninth mux 309 selects any one of multiple middle voltages output from the ninth resistor string 329 and outputs the selected middle voltage as a 151st voltage V151.

A tenth resistor string 330 may receive a reference voltage VT and a 255th grayscale voltage V255 and generate middle voltages between the reference voltage VT and the 255th grayscale voltage V255.

A tenth mux 310 selects one of multiple middle voltages output from tenth resistor string 330 and outputs the selected middle voltage as 203rd grayscale voltage V203.

Resistors R1 to R9 may be coupled between each output terminal of second to tenth mux 302 to 310. In one embodiment, the number of resistors in the second to tenth resistor strings 322 to 330 may be set equally. In one embodiment, the number of resistors in the first resistor string 321 may be set to be greater than the number of resistors in the resistor strings 322 to 330.

FIG. 3 illustrates an embodiment where a 0th grayscale voltage V0, a first grayscale voltage V1, an eleventh grayscale voltage V11, a 23rd grayscale voltage V23, a 35th grayscale voltage V35, a 51st grayscale voltage V51, an 87th grayscale voltage V87, a 151st grayscale voltage V151, a 203rd grayscale voltage V203 and a 255th grayscale voltage V255 are generated. The number and type of grayscale voltages may be different in another embodiment. Also, the mux structure may be different in another embodiment.

A grayscale voltage output unit 350 may generate a greater number of grayscale voltages using the grayscale voltages V0, V1, V11, V23, V35, V51, V87, V151, V203 and V255 from the first to tenth mux 301 to 310. For example, a grayscale voltage output unit 350 may interpolate the eleventh grayscale voltage V11 and the 23rd grayscale voltage V23, to thereby generate twelfth to 22nd grayscale voltage V12 to V22 therebetween. Remaining grayscale voltages may all be generated using, for example, the aforementioned method. Therefore, the grayscale voltage output unit 350 may supply 0th to 255th grayscale voltages V0 to V255 to the data driver 220.

The mux 300 to 310 may be controlled corresponding to the register value from the register unit 360.

Figures 4, 5:
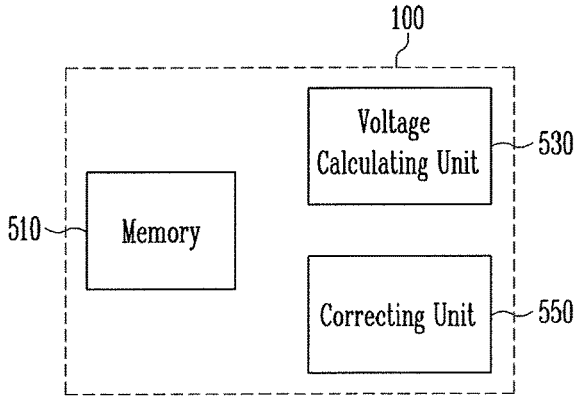
FIG. 4 illustrates an example of gamma set data stored in a register.
FIG. 5 illustrates an embodiment of a gamma set data correcting device.

FIG. 4 illustrates an example of a gamma set data stored in register unit 360 in FIG. 3. The register unit 360 may store multiple gamma set data GSD13, GSD11 to GSD1. The gamma set data GSD13, GSD11 to GSD1 may be supplied from a gamma set data correcting device 100. Each gamma set data GSD13, GSD11 to GSD1 may be related to dimming level. For example, thirteenth gamma set data GSD13 may be related to a 255th dimming level. Eleventh gamma set data GSD11 may be related to a 215th dimming level.

Gamma set data that is related to a different dimming level may be calculated by interpolating two gamma set data. In one embodiment, twelfth gamma set data GSD12 related to a 216th dimming level may be generated by interpolating 13th gamma set data GSD13 and eleventh gamma set data GSD11. For example, a register value of the twelfth gamma set data GSD12 may be calculated by the following equation:

$$B.Reg=A.Reg-(A.Reg-C.Reg)*(A-B)/(A-C)$$

where B.Reg is the register value of the twelfth gamma set data GSD12, A.Reg is the register value of the 13th gamma set data GSD13, C.Reg is the register value of the eleventh gamma set data GSD11, A is the dimming level of the 13th gamma set data GSD13, B is the dimming level of the twelfth gamma set data GSD12, and C is the eleventh gamma set data GSD11.

If the 255th dimming level is set by a user, control signal, or program, the register unit 360 may supply corresponding register values to the mux 300 to 310 by referring to the 13th gamma set data GSD13. For example, when the grayscale voltages related to red R are generated, the reference register value "85 " corresponding to the reference voltage VT may be supplied to the reference voltage mux 300. The register value ""266" corresponding to the 255th grayscale G255 may be supplied to the first mux 301. The register values corresponding to the remaining grayscales G0 to G203 may be supplied to the second to tenth mux 302 to 310, respectively.

Each of mux 300 to 310 may select any one of multiple middle voltages which are input and output it corresponding to the register value from the register unit 360. For example, if the low gamma set data corresponding to the relatively low dimming level has a greater register value than the high gamma set data corresponding to a relatively high dimming level, there may be some problem with brightness. For example, a brightness reversal phenomenon may occur in which the screen may become brighter even though the dimming level is lowered.

In accordance with embodiments, a gamma set correcting device and method are provided to prevent a brightness reversal phenomenon by correcting the gamma set data before supplying it to the display device 200.

FIG. 5 illustrates an embodiment of a gamma set data correcting device 100. FIG. 6 illustrates an example of a high gamma set data and a low gamma set data. FIG. 7 illustrates an example of voltage values calculated based on a portion of the low gamma set data. For convenience, only voltage values related to red R are in FIG. 7.

Referring to FIG. 5, the gamma set data correcting device 100 includes a memory 510, a voltage calculating unit 530 and a correcting unit 550. The memory 510 may store high gamma set data GSD_H and low gamma set data GSD_L. The high gamma set data GSD_H may be gamma set data related to a relatively high dimming level. The low gamma set data GSD_L may be gamma set data related to a relatively low dimming level.

For example, the high gamma set data GSD_H may correspond to the 13th gamma set data GSD13 in FIG. 4, and the low gamma set data GSD_L may correspond to the eleventh gamma set data GSD11 in FIG. 4. The high gamma set data GSD_H and low gamma set data GSD_L may be supplied to register unit 360 in the display device 200 at least after a portion of the register value is corrected by a correcting unit 550.

The high gamma set data GSD_H may include first register values set per grayscale G0 to G255 and a first reference register value corresponding to the reference voltage VT. The low gamma set data GSD_L may include second register values set per grayscale G0 to G255 and a second reference register value corresponding to the second register values and the reference voltage VT. In one embodiment, the high gamma set data GSD_H and the low gamma set data GSD_L may include three register sets: red R; green G; and blue B. In another embodiment, the high and low gamma set data may include a different number of register sets or three register sets for a difference combination of colors.

The voltage calculating unit 530 may calculate a voltage value corresponding to each of the second register values based on the second register values in the low gamma set data GSD_L. The voltage calculating unit 530 may calculate the reference voltage value of the low gamma set data GSD_L based on the second reference register value and calculate fixed voltage values per grayscale of the low gamma set data GSD_L based on the second register values. For example, the voltage calculating unit 530 may calculate reference voltage values from the second reference register value based on Formula 1.

$$VT1=VREG1-VREG1*(RVr/N2) \quad (1)$$

where VT1 is the reference voltage value, VREG1 is the first constant, RVr is the second reference register value, and N2 is the second constant.

For example, if the second reference register value RVr is "85", the reference voltage value VT1 may be calculated by substituting "85" with the second reference register value RVr in Formula 1.

The voltage calculating unit 530 may also calculate a fixed voltage value corresponding to the highest grayscale (e.g., the highest grayscale from the second register value corresponding to the 255th grayscale G255) based on Formula 2.

$$Vgh=VREG1-VreG1*(RVh/N3) \quad (2)$$

where Vgh is the fixed voltage value of the highest grayscale, VREG1 is the first constant, RVh is the second register value corresponding to the highest grayscale, and N3 is the third constant.

For example, if the second register value RVh corresponding to the 255th grayscale G255 which is the highest grayscale is "266", the fixed voltage value Vgh that corresponds to the highest grayscale may be calculated by substituting "266" with RVh in Formula 2.

The voltage calculating unit 530 may also calculate fixed voltage values corresponding to the remaining grayscales from the second register values corresponding to remaining grayscales except for the highest grayscale using Formula 3.

$$Vgc=VT1-(VT1-Vgp)*(RVcN4) \quad (3)$$

where Vgc is the fixed voltage value of the current grayscale, VT1 is the reference voltage value, Vgp is the fixed voltage value of the grayscale that is one level higher than the current grayscale, RVc is the second register value corresponding to the current grayscale, and N4 is the fourth constant.

For example, since the grayscale that is one level higher than a 203rd grayscale G203 with respect to the low gamma set data GSD_L is the 255th grayscale G255, the fixed voltage value Vg203 corresponding to the 203rd grayscale G203 may be calculated by the following formula.

$$Vg203=VT1-(VT1-Vgh)*(RV203/N4)$$

If the second register value RV203 corresponding to the 203rd grayscale G203 is "230", the fixed voltage value Vg203 corresponding to the 203rd grayscale G203 may be calculated by substituting "230" into the formula above.

In the same manner, the fixed voltage value Vg151 corresponding to 151st grayscale G151 may be calculated by the following formula.

$$Vg151=VT1-(VT1-Vg203)*(RV151/N4)$$

If the second register value RV151 corresponding to the 151st grayscale G151 is "224", the fixed voltage value Vg151 corresponding to the 151st grayscale G151 may be calculated by substituting "224" into the above formula.

The fixed voltage values Vg0, Vg1, Vg11, Vg23, Vg35, Vg51 and Vg87 corresponding to the remaining grayscales G0, G1, G11, G23, G35, G51 and G87 may be calculated in an analogous manner.

The calculated voltage values illustratively shown in FIG. 7. Even though only the voltage values related to red R are shown in FIG. 7, the voltage values related to green G and blue B may also be calculated using the same method.

The reference voltage value VT1 may be the same as the value of the reference voltage VT that is output from the reference voltage mux 300 when the grayscale voltage generator 260 operates in response to the low gamma set data GSD_L.

Also, the fixed voltage values Vg0, Vg1 , Vg11, Vg23, Vg35, Vg51, Vg87, Vg151, Vg203 and Vg255 may be the same as the grayscale voltages V0, V1, V11, V23, V35, V51, V87, V151, V203 and V255, respectively, output from the first to tenth mux 301 to 310 when the grayscale voltage generator 260 operates in response to the low gamma set data GSD_L.

The first constant VREG1 may have the same value as the first power voltage VHI. Also, the second constant N2 and the third constant N3 may be the same as the number of resistors in the first resistor string 321. The fourth constant N4 may be the same as the number of resistors in the second resistor string 322.

The correcting unit 550 may compare the first register value of the high gamma set data GSD_H corresponding to a certain grayscale and the second register value of the low gamma set data GSD_L. Upon comparison, if the second register value is greater than the first register value, the correcting unit 550 may change the second register value to be the same as the first register value.

The correcting unit 550 may compare the first register value and the second register value in the order from the high grayscale to the low grayscale. For example, the first register value and the second register value may be compared in the order from the highest grayscale (e.g., the 255th grayscale G255) to the lowest grayscale (e.g., 0th grayscale G0).

The first register value and the second register value may be compared in the order from the highest grayscale (e.g., the near highest grayscale excluding the 255th grayscale G255 (e.g., the 203rd grayscale G203)) to the lowest grayscale (e.g. the 0th grayscale G0).

For example, with respect to the register values related to red R among the high gamma set data GSD_H and the low gamma set data GSD_L in FIG. 6, the correcting unit 550 may compare the first register value "266" and the second register value "251" based on the 255th grayscale G255.

Upon comparison, since the second register value "251" is smaller than the first register value "266," the first register value and the second register value may be compared based on the next low grayscale. As described above, comparison of the first register value and the second register value based on the highest grayscale may be omitted.

The correcting unit 550 may detect that the second register value "232" is greater than the first register value "230" from the 203$^{rd}$ grayscale (G203). Accordingly, the correcting unit 550 may change the second register value corresponding to the 203$^{rd}$ grayscale G203 to "230" which is the same as the first register value.

If the second register value changes in a state where the fixed voltage value Vg203 corresponding to the 203$^{rd}$ grayscale G203 and the fixed voltage value Vgh corresponding to the highest grayscale G255 are maintained, the reference voltage value VT1 must be changed in order to satisfy Formula 3. Therefore, the reference voltage value VT1 may be updated to a value satisfying the following formula.

$$Vg203=VT1'-(VT1'-Vgh)*(RV203'/N4)$$

where VT1' is the updated reference voltage value, and RV203' is the updated second register value that corresponds to the 203$^{rd}$ grayscale G203.

Thereafter, based on the updated reference voltage value VT1' and Formula 3, the correcting unit 550 may update second register values that correspond to the remaining grayscales GO, G1, G11, G23, G35, G51, G87 and G151 excluding the 203$^{rd}$ grayscale G203 and the 255$^{th}$ grayscale G255 which is the highest grayscale.

For example, but without limitation thereto, in a state where the fixed voltage value Vg151 corresponding to the 151$^{st}$ grayscale G151 and the fixed voltage value Vg203 corresponding to the 203$^{rd}$ grayscale G203, the second register value RV151 corresponding to the 151$^{st}$ grayscale G151 may be updated to a value that satisfies the following formula.

$$Vg151=VT1'-(VT1'-Vg203)*(RV151'/N4)$$

where RV151' is the updated second register value corresponding to the 151$^{st}$ grayscale G151. The second register values corresponding to the remaining grayscales GO, G1, G11, G23, G35, G51 and G87 may be updated using the same method.

The correcting unit 550 may update the second reference register value RVr to a value that satisfies Formula 1 based on the updated reference voltage value VT1'. For example, the second reference register value RVr may be updated to a value that satisfies the following formula:

$$VT1'=VREG1-VREG1*(RVr'/N2)$$

where RVr' is the updated second reference register value.

Through the operations of the correcting unit 550 as described above, the low gamma set data GSD_L may be updated on the whole.

Thereafter, with respect to the high gamma set data GSD_H and the updated low gamma set data GSD_L, the correcting unit 550 may perform comparison of the first register value and the second register value again. Since comparison is performed until the 203$^{rd}$ grayscale G203, comparison of the first register value and the second register value may be performed based on the next grayscale, the 151$^{st}$ grayscale G151. The operations of the correcting unit 550 repeat in the same manner as describe above.

If the register comparison operation of the correcting unit 550 is performed with respect to all of the grayscales and if the updating of the low gamma set data GSD_L is completed, the correcting unit 550 may determine if the second reference register value of the low gamma set data GSD_L exceeds a predefined comparison value and if there is "0" among the second register values of the low gamma set data GSD_L.

If the second reference register value of the low gamma set data GSD_L exceeds the predefined comparison value, the correcting unit 550 may reduce the second reference register value to the comparison value or less. To this end, the correcting unit 550 may perform correction operation with respect to the low gamma set data GSD_L again after reducing the value of the first constant VREG1 used in Formula 1 and Formula 2.

Also, if there is a second register value having "0" in the low gamma set data GSD_L, the second register value having "0" may be increased. To this end, the correcting unit 550 may perform correction operation with respect to the low gamma set data GSD_L again after reducing the value of the first constant VREG1 used in Formula 1 and Formula 2.

In the above embodiment, two gamma set data are described as being stored in the memory 510. A different number of gamma set data may be stored in the memory 510 in another embodiment. For example, multiple gamma set data GSD13, GSD11 to GSD1 may be stored in the memory 510 as described with reference to FIG. 4.

A correction operation of the correcting unit 550 may be performed with respect to the $13^{th}$ gamma set data GSD13 which is relatively high gamma set data and the eleventh gamma set data GSD11 which is relatively low gamma set data.

Thereafter, a correction operation of the correcting unit 550 may be performed with respect to the eleventh gamma set data GSD11 which is relatively high gamma set data and the ninth gamma set data GSD9 which is relatively low gamma set data.

By repeating the above-described operations, the tendency may be maintained in which the register value becomes smaller from the high gamma set data to the low gamma set data. Accordingly, no brightness reversal phenomenon may occur.

Figure 8:
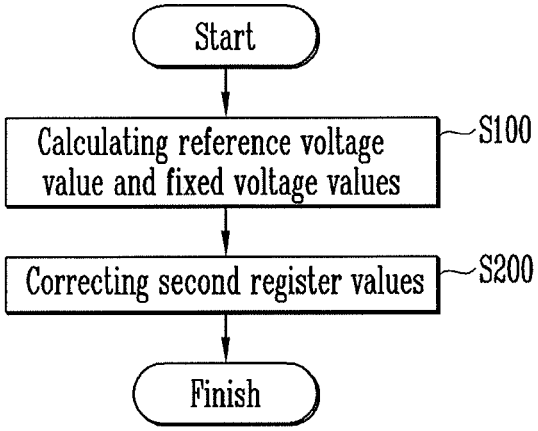
FIG. 8 illustrates an embodiment of a method for correcting gamma set data.
Figure 9:
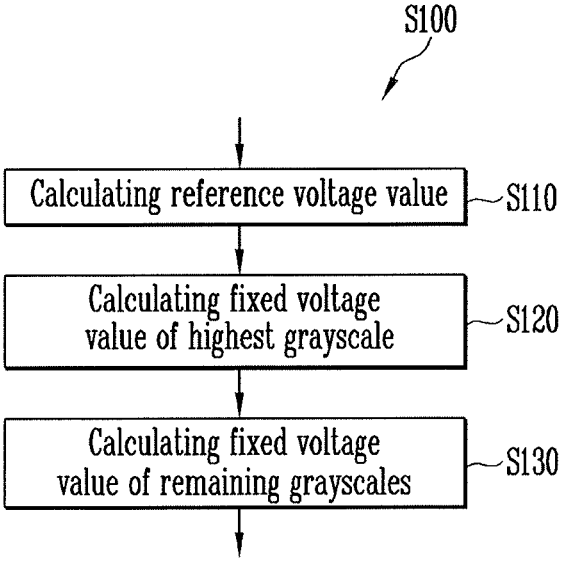
FIG. 9 illustrates an example of an operation for calculating a reference and fixed voltage values.
Figure 10:
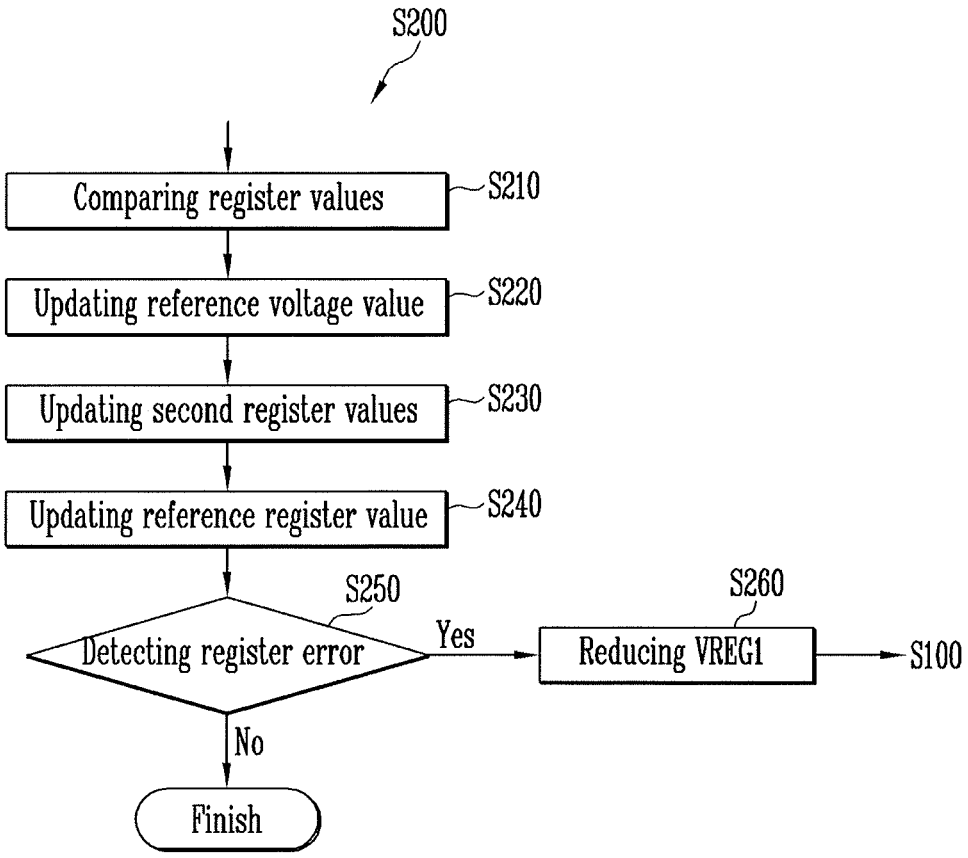
FIG. 10 illustrates an example of an operation for correcting register values.

FIG. 8 illustrates an embodiment of a gamma set data correcting method. FIG. 9 illustrates an operation for calculating a reference voltage value and fixed voltage values. FIG. 10 illustrates an embodiment of an operation for correcting second register values.

Referring to FIG. 8, the method for correcting gamma set data includes calculating a reference voltage value and fixed voltage values (S100) and correcting second register values (S200).

In calculating the reference voltage value and the fixed voltage values (S100), the reference voltage value of the low gamma set data GSD_L and the fixed voltage values per grayscale may be calculated using the second reference register value included in the low gamma set data GSD_L and the second register values set per grayscale are used to calculate.

In calculating the reference voltage value and the fixed voltage values (S100), the reference voltage value may be calculated using the second reference register value and the fixed voltage values per grayscale may be calculated using the second register values.

Referring to FIG. 9, the calculating of the reference voltage value and the fixed voltage values (S100) may include calculating the reference voltage value (S110), calculating the fixed voltage value of the highest grayscale (S120) and calculating fixed voltage value of the remaining grayscales (S130).

In calculating the reference voltage value (S110), the reference voltage value may be calculated from the second reference register value using Formula 1 below:

$$VT1=VREG1-VREG1*(RVr/N2)$$

where VT1 is the reference voltage value, VREG1 is the first constant, RVr is the second register value, and N2 is the second constant.

In calculating the fixed voltage value of the highest grayscale (S120), the fixed voltage value corresponding to the highest grayscale may be calculated from the second register value corresponding to the highest grayscale (e.g., the $255^{th}$ grayscale G255) using Formula 2 below:

$$Vgh=VREG1-VREG1*(RVh/N3)$$

where, Vgh is the fixed voltage value of the highest grayscale, VREG1 is the first constant, RVh is the second register value corresponding to the highest grayscale and N3 is the third constant.

In calculating the fixed voltage value of the remaining grayscales, the fixed voltage values corresponding to the remaining grayscales may be calculated from the second register values corresponding to remaining grayscales excluding the highest grayscale using Formula 3 below:

$$Vgc=VT1-(VT1-Vgp)*(RVc/N4)$$

where Vgc is the fixed voltage value of the current grayscale, VT1 is the reference voltage value, Vgp is the fixed voltage value of the grayscale that is one level higher than the current grayscale, RVc is the second register value corresponding to the current grayscale, and N4 is the fourth constant.

Referring to FIG. 10, correcting the second register values (S200) may include comparing register values (S210), updating a reference voltage value (S220), updating second register values (S230), and updating the reference register value (S240). In comparing the register value (S210), the first register values in the high gamma set data GSD_H and the second register values in the low gamma set data GSD_L may be compared per grayscale. For example, in comparing the register value (S210), the first register value of the high gamma set data GSD_H corresponding to a certain grayscale and the second register value of the low gamma set data GSD_L may be compared. Based on this comparison, the second register value may be changed to be the same as the first register value if the second register value is greater than the first register value.

Comparison of the first register values and the second register values may proceed in the order from the high grayscale to the low grayscale.

If it is determined that the second register value corresponding to a certain grayscale is greater than the first register value and the second register value is changed to be the same as the first register value, updating the reference voltage value (S220) may include updating the reference voltage value to a value that satisfies Formula 3 using the fixed voltage value corresponding to a certain grayscale and the second register value which has been changed.

In updating the second register values (S230), the second register values corresponding to remaining grayscales excluding certain grayscale and the highest grayscale may be updated using the updated reference voltage value and Formula 3.

In updating the reference register value (S240), the reference register value may be updated to a value that satisfies Formula 1 using the updated reference voltage value.

Referring to FIG. 10, correcting the second register values (S200) may further include detecting register error (S250) and reducing VREG1 (S260). Once register comparison operation of the correcting unit 550 with respect to all grayscales is completed, if update of the low gamma set data GSD_L is complete, register error detection (S250) may be performed.

In detecting register error (S250), it may be determined if the second reference register value of the low gamma set data GSD_L exceeds the predefined comparison value and if there is "0" among the second register values of the low gamma set data GSD_L. For example, if the second reference register value of the low gamma set data GSD_L exceeds the predefined comparison value, and/or if there is "0" among the register values of the low gamma set data GSD_L, reducing of VREG1 (S260) may be performed.

In reducing of VREG1 (S260), the value of the first constant VREG1 used in Formula 1 and Formula 2 is reduced to the predefined size. Thereafter, calculating the reference voltage value and the fixed voltage values (S100)

may be performed again. If a register error is not detected during the operation of detecting register error (S250), correcting the second register values (S200) may be finished.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The correcting devices, controllers, generators, calculators, units, and other processing features of the embodiments disclosed herein may be implemented in logic which, for example, may include hardware, software, or both. When implemented at least partially in hardware, the correcting devices, controllers, generators, calculators, units, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the correcting devices, controllers, generators, calculators, units, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. A method of correcting gamma set data, the method comprising:

calculating a reference voltage value and fixed voltage values per grayscale of a low gamma set data based on a reference register value and second register values set per grayscale in the low gamma set data;

comparing first register values in a high gamma set data with second register values in the low gamma set data; and correcting the second register values depending on a comparison result.

2. The method as claimed in claim 1, wherein calculating the reference voltage value and fixed voltage values per grayscale includes calculating the reference voltage value from the reference register value based on Formula 1:

$$VT1 = VREG1 - VREG1*(RVr/N2)$$

where VT1 is a reference voltage value, VREG1 is a first constant, RVr is a reference register value and N2 is a second constant.

3. The method as claimed in claim 2, wherein calculating the reference voltage value and fixed voltage values per grayscale includes calculating a fixed voltage value from a second register value corresponding to highest grayscale based on Formula 2:

$$Vgh = VREG1 - VREG1*(RVh/N3)$$

where Vgh is a fixed voltage value of the highest grayscale, VREG1 is a first constant, RVh is a second register value corresponding to the highest grayscale, and N3 is a third constant.

4. The method as claimed in claim 3, wherein calculating the reference voltage value and fixed voltages per grayscale includes calculating fixed voltage values from second register values corresponding to remaining grayscales excluding the highest grayscale based on Formula 3:

$$Vgc = VT1 - (VT1 - Vgp)*(RVc/N4)$$

where Vgc is a fixed voltage value of a current grayscale, VT1 is a reference voltage value, Vgp is a fixed voltage value of a grayscale that is one level higher than the current grayscale, RVc is a second register value corresponding to the current grayscale, and N4 is a fourth constant.

5. The method as claimed in claim 4, wherein correcting the second register values includes:

comparing a first register value corresponding to a certain grayscale with a second register value corresponding to the certain grayscale; and changing the second register value to be equal to the first register value when the second register value is greater than the first register value.

6. The method as claimed in claim 5, wherein correcting the second register values includes updating the reference voltage value to a value that satisfies Formula 3 based on a fixed voltage value corresponding to the certain grayscale and the changed second register value.

7. The method as claimed in claim 6, wherein correcting the second register values includes updating second register values corresponding to remaining grayscales excluding the certain grayscale and the highest grayscale based on the updated reference voltage value and the Formula 3.

8. The method as claimed in claim 7, wherein correcting the second register values includes updating the reference register value to a value that satisfies Formula 1 based on the updated reference voltage value.

9. The method as claimed in claim 8, wherein correcting the second register values includes reducing the reference register value to the comparison value or less when the updated reference register value exceeds a predefined comparison value.

10. The method as claimed in claim 8, wherein correcting the second register values includes increasing a second register value having a value of 0 when there is a second register value having the value of 0 in the low gamma set data.

* * * * *